US009066547B2

(12) United States Patent
Kim

(10) Patent No.: US 9,066,547 B2
(45) Date of Patent: Jun. 30, 2015

(54) JACKET HAVING A WARMING POCKET IN WHICH POCKETS ON BOTH SIDES CAN BE JOINED AND SEPARATED

(76) Inventor: Go Kyeong Kim, Seoul (KR)

( * ) Notice: Subject to any disclaimer, the term of this patent is extended or adjusted under 35 U.S.C. 154(b) by 603 days.

(21) Appl. No.: 13/513,717

(22) PCT Filed: Dec. 2, 2010

(86) PCT No.: PCT/KR2010/008590

§ 371 (c)(1),
(2), (4) Date: Jun. 4, 2012

(87) PCT Pub. No.: WO2011/068370

PCT Pub. Date: Jun. 9, 2011

(65) Prior Publication Data

US 2012/0266351 A1 Oct. 25, 2012

(30) Foreign Application Priority Data

Dec. 4, 2009 (KR) ..... 10-2009-0119474
Mar. 4, 2010 (KR) ..... 10-2010-0019577

(51) Int. Cl.
*A41D 27/20* (2006.01)
*A41D 1/02* (2006.01)

(52) U.S. Cl.
CPC . *A41D 27/20* (2013.01); *A41D 1/02* (2013.01); *A41D 2400/10* (2013.01)

(58) Field of Classification Search
CPC ..... A41D 1/03; A41D 27/20; A41D 3/005; A41F 1/00
See application file for complete search history.

(56) References Cited

U.S. PATENT DOCUMENTS

| | | | | | |
|---|---|---|---|---|---|
| 2,324,722 | A * | 7/1943 | Papierniak | 2/93 |
| 2,560,243 | A * | 7/1951 | Peterson | 602/4 |
| 3,077,604 | A * | 2/1963 | Colangelo | 2/93 |
| 3,217,335 | A * | 11/1965 | Bell | 2/93 |
| 4,651,348 | A * | 3/1987 | Swanson | 2/93 |
| 4,773,102 | A * | 9/1988 | Curtis et al. | 2/93 |
| 4,882,786 | A * | 11/1989 | Gross | 2/94 |
| 7,467,423 | B1 * | 12/2008 | Tawfik | 2/207 |
| 7,496,969 | B2 * | 3/2009 | Pieczynski | 2/16 |

(Continued)

FOREIGN PATENT DOCUMENTS

| | | |
|---|---|---|
| JP | 2002-309414 | 10/2002 |
| JP | 2003-328213 | 11/2003 |

(Continued)

OTHER PUBLICATIONS

International Search Report for PCT/KR2010/008590 mailed Aug. 23, 2011.

*Primary Examiner* — Richale Quinn
(74) *Attorney, Agent, or Firm* — AKC Patents, LLC; Aliki K. Collins

(57) ABSTRACT

Disclosed is a jacket having warm pockets with both pockets being attachable and detachable which is characterized in that in an ordinary jacket which can be opened and closed by a certain engaging element such as a zipper and buttons and has a pocket at left and right sides formed about the engaging element, respectively, for a user to insert his hands into the left and right pockets, both the separated pockets can communicate like one longitudinal pocket, and a tube-like passage is formed from both the pockets and the backside of a jacket, and a warming element is accommodated in both the pockets or the tube-like passage for the purpose of effectively warming the hands of a user as well as a user's body.

13 Claims, 11 Drawing Sheets

(56) References Cited

U.S. PATENT DOCUMENTS

| | | | | |
|---|---|---|---|---|
| 7,779,486 | B2 * | 8/2010 | Tomlinson et al. | 2/94 |
| 8,234,720 | B2 * | 8/2012 | Freedman et al. | 2/128 |
| 2006/0010569 | A1 * | 1/2006 | Tawfik | 2/207 |

FOREIGN PATENT DOCUMENTS

| | | |
|---|---|---|
| KR | 20-0261036 | 1/2002 |
| KR | 20-0281680 | 7/2002 |
| KR | 2003-89555 | 7/2005 |

* cited by examiner

JACKET HAVING A WARMING POCKET IN WHICH POCKETS ON BOTH SIDES CAN BE JOINED AND SEPARATED

RELATED APPLICATIONS

This application is a 371 application of International Application No. PCT/KR2010/008590, filed Dec. 2, 2010, which in turn claims priority from Korean Patent Application Nos. 10-2010-0019577, filed Mar. 4, 2010, and 10-2009-0119474, filed Dec. 4, 2009, each of which is incorporated herein by reference in its entirety.

TECHNICAL FIELD

The present invention relates to a jacket having warm pockets with both pockets being attachable and detachable which is characterized in that in an ordinary jacket which can be opened and closed by a certain engaging element such as a zipper and buttons and has a pocket at left and right sides formed about the engaging element, respectively, for a user to insert his hands into the left and right pockets, both the separated pockets can communicate like one longitudinal pocket, and a tube-like passage is formed from both the pockets and the backside of a jacket, and a warming element is accommodated in both the pockets or the tube-like passage for the purpose of effectively warming the hands of a user as well as a user's body.

BACKGROUND ART

A modern person generally tends to wear thinner clothes for the purpose of enhancing an aesthetic appearance while satisfying convenience during the activity in a cold winter, to meet the demand of which a variety of functional clothes are disclosed in the market so as to enhance a warming performance of thin clothes.

The above-mentioned clothes should be thin enough and substantially needs a function of satisfying the demand for warms. In a case of special clothes, various types of clothes such as a fur clothes, a goose down clothes, a padding clothes, etc. are generally used when a special warming performance is required.

The above-mentioned clothes, however, has a limit in obtaining a desired warming effect in the event that a cloth is thin, even a functional cloth, and in the event of a thick cloth, there is actually a limit in keeping a warm in the very cold weather.

In case of a jacket which is usually worn in a cold winter, it is opened and closed by an engaging element such as a zipper or buttons disposed at a front center of the jacket. A pocket is formed at left and right sides, respectively, about the engaging element. A user might use the jacket with its front center opened depending on a user's convenience. In a cold winter, a user inputs both hands into the pockets for warming the hands.

It is hard to maximize warming effects with only a jacket as well as there is a limit in warming hands. There is actually a difficulty in keeping a warming effect with an ordinary jacket when a user stays outdoors for golf, inline stake, mountain climbing, fishing, etc. In case of sports activity like golf, a player prefers to wear a thin glove now what a gripping of a golf club is important. In the winter, a golf player prefers to wear a thin and skinny wind jacket in order for his swing action not to be interrupted with. Since only a small size pocket to store a tee or the like is formed to make the clothes look simple, it is hard to input hands in the pockets. So, when a player keeps playing a golf game with a thin golf glove worn under an external environment of a low temperature, it is hard for a player to play with a good score because a player's hand finger loses feeling.

DISCLOSURE OF INVENTION

Accordingly, the present invention is made to resolve the above-mentioned conventional problems. It is an object of the present invention to provide a jacket having warm pockets with both pockets being attachable and detachable which makes it possible to provide a thin cloth and maximize a warming effect of hands in such a way that a pocket is formed at front left and right sides and is attachable and a heating element can be accommodated in each pocket.

It is another object of the present invention to provide a jacket having warm pockets with both pockets being attachable and detachable which makes it possible to maximize a warming effect of hands and enhance a warming function for a user's body in such a way that a tube-like passage is formed from both pockets to a backside of a jacket, thus consequently making both the pockets communicate with each other, the heating element being accommodated in the tube-like passage.

To achieve the above objects, there is provided a jacket having warm pockets with both pockets being attachable and detachable which is opened and closed by means of an engaging element such as a zipper, buttons, etc. and a user can input hands into left and right sides about the engaging element, comprising an opening and closing part which opens and closes an end portion of one side of the pocket and is provided at an inner side of the jacket close to the opened end portion of the pocket; and a plurality of engaging means which are provided at one side of the opening and closing part, both the pockets being connected by means of the engaging means of both sides after the opening and closing part is opened.

Here, an opening part is formed at one side of an inner surface of the pocket, and a tube-like passage is connected from the opening part of the pocket formed at both sides to the interior of the backside, so the pockets of both sides communicate with each other.

A connection raw cloth member is engaged to an end portion of the pocket, and an engaging member is provided at one side of the connection raw cloth member, so the connection raw cloth members of both sides are engaged with each other by means of each engaging member after the opening and closing part is opened.

A plurality of heating element accommodation pockets are provided at an inner side of the pocket or at a tube-like passage for thereby accommodating the heating element.

A warming cover pocket is provided at an upper surface of the heating element accommodation pocket.

An input part is formed at one side of the jacket close to the heating element accommodation pocket for the purpose of accommodating the heating element in the heating element accommodation pocket.

There is provided a close contact means by which the heating element accommodation pocket comes into close contact with a body, and an operation opening and closing part is formed at one side of the jacket for the purpose of easily operating the close contact means.

The close contact means has a cut-away part at one side of the jacket and is divided into two parts, and an adhering member is provided at one side of the cut-away part for thereby adhering by adjusting both the divided sides to a users body shape.

In addition, the close contact means helps the heating element accommodation pocket come into close contact with a body by forming part or all parts of the jacket of a flexible material.

In addition, the close contact means is characterized in that the other side of a length adjusting band having an engaging part at its one side is engaged to one side of the jacket, and a ring through which the length adjusting band passes is provided at one side of the jacket, and the length adjusting band passes through the ring and comes out of the ring, and each length adjusting band is engaged using the engaging part, and the jacket is tightened, so the heating element accommodation pocket comes into close contact with a body.

In addition, the close contact means is characterized in that an engaging part is provided at one side of the length adjusting band both ends of which are engaged to one side of the jacket, and the ring through which the length adjusting band passes is provided at one side of the jacket, and the length adjusting band surrounds the backside of the jacket, and as the length adjusting band is pulled forward using each engaging part, it is engaged, so the heating element accommodation pocket comes into close contact with a body by tightening the jacket.

The length adjusting band is detachable from one side of the jacket.

Advantageous Effects

The present invention is advantageously characterized in that a jacket is made of a thin cloth which results in a convenient activity and results in an enhanced aesthetic appearance, and the warming effects of hands and a body can be maximized, so it is possible to satisfy the demand of a customer who prefers to wear a thin clothes as well as a warming function, and a method for maximizing a warming effect can be achieved in an easier way.

MODES FOR CARRYING OUT THE INVENTION

Figure 1:
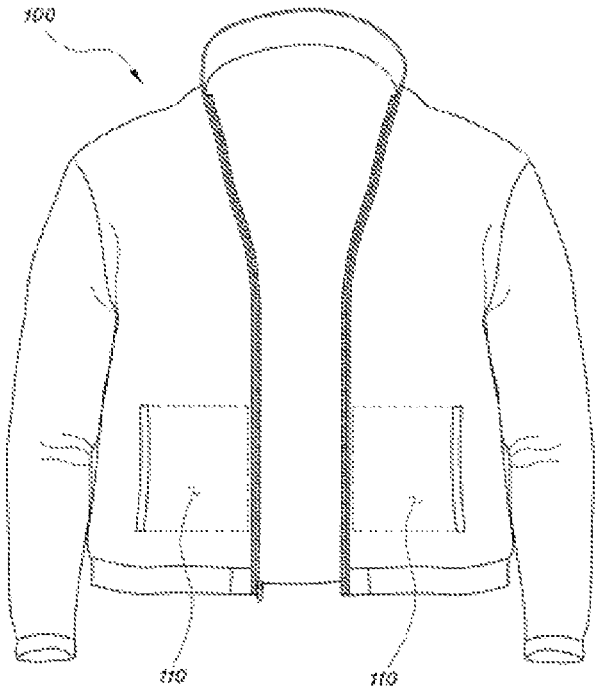
FIG. 1 is a view illustrating a conventional jacket in which an opening and closing part is disposed at a front, central portion, and a pocket is provided at both sides.

The preferred embodiments of the present invention will be described, but they are not limited thereto unless their subject matters escape.

To achieve the above mentioned advantageous effects, in a jacket 100 having warm pockets 110 with both pockets being attachable and detachable which is opened and closed by means of an engaging element such as a zipper, buttons, etc. and a user can input hands into left and right sides about the engaging element, as one aspect of the present invention, there are provided an opening and closing part 101 which opens and closes an end portion of one side of the pocket 110 and is provided at an inner side of the jacket 100 close to the opened end portion of the pocket 110; and a plurality of engaging means 111 which are provided at one side of the opening and closing part 101, both the pockets 110 being connected by means of the engaging means 111 of both sides after the opening and closing part 101 is opened. As another aspect of the present invention, an opening part 112 is formed at one side of an inner surface of the pocket 110, and a tube-like passage 113 is connected from the opening part 112 of the pocket 110 formed at both sides to the interior of the backside, so the pockets 110 of both sides communicate with each other.

The construction of the present invention will be described with reference to the accompanying drawings.

FIG. 1 is a view illustrating a conventional jacket 100 which is opened and closed by means of an engaging element such as a zipper or buttons and in which a pocket 110 is formed at both left and right sides about the engaging element, with a users hands being inputted into the pockets. The features of the present invention are added to the conventional jacket 100 of FIG. 1. Here, an inner end portion of each pocket 110 is open according to the present invention.

Figure 2:
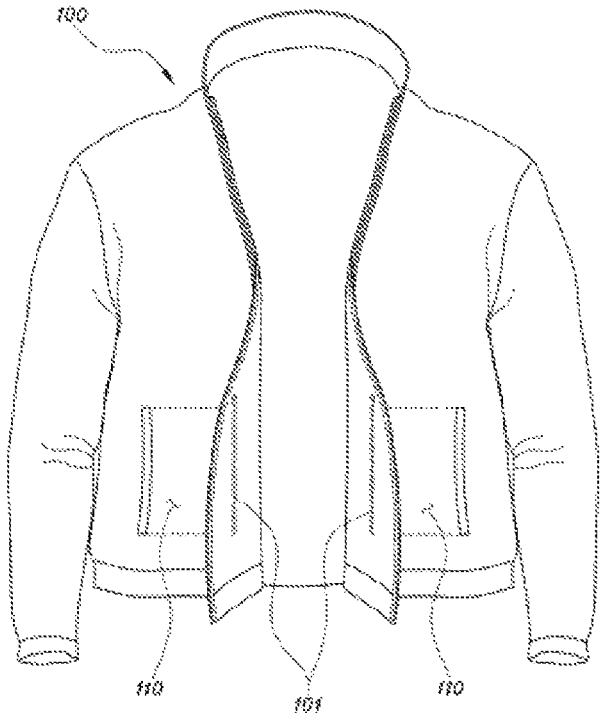
FIG. 2 is a view illustrating a state that an opening and closing part is provided at an inner side of a jacket according to the present invention.

FIG. 2 shows an opening and closing part 101 of the present invention. As shown therein, an opening and closing part 101 is provided at an inner side of the jacket 100. At this time, the opening and closing part 101 is provided at a portion close to an inner end portion of each pocket 110, so both the pockets 110 of both sides come to communicate with each other.

The opening and closing part 101 might be manufactured in various forms such as a zipper, a Velcro tape, buttons, etc.

Figure 3:
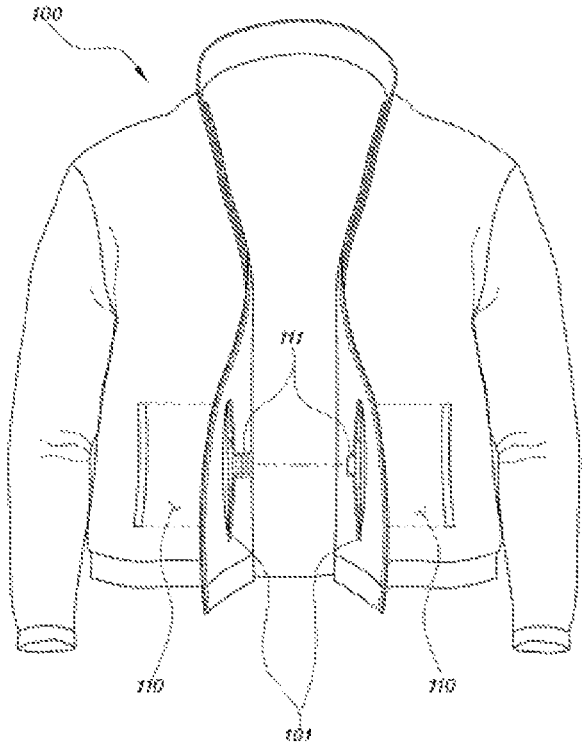
FIG. 3 is a view illustrating a state that an engaging part, which opens an opening and closing part, is provided at an inner side of an opening and closing part according to the present invention.

FIG. 3 shows a construction that there is provided an engaging part 111 as a means for engaging the pockets 110 of both sides according to the present invention. As shown therein, an engaging part 111 is provided at an inner side of the opening and closing part 101. Both the pockets 110 are engaged with each other by engaging the engaging parts 111 of both sides following the opening of the opening and closing part 101.

The pockets 110 of both sides are made communicate with each other, thus consequently forming a long passage-shaped pocket 110, so it is possible to obtain a better hand warming effect as compared with the separated pockets 110.

Figure 4:
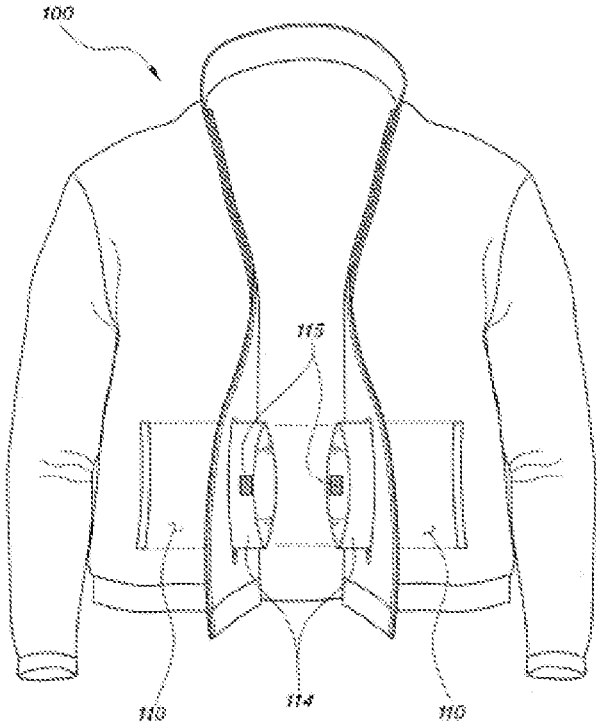
FIG. 4 is a view illustrating a connection raw cloth member according to the present invention.

FIG. 4 shows a construction that there is provided a connection raw cloth member 114. As shown therein, a connection raw cloth member 114 is provided at an end portion of each pocket 110, so it is possible to more efficiently engage the pockets 110 of both sides. With the above construction, there is not formed any gap between the pockets 110 when connecting the pockets 110 of both sides, thus maximizing a warming effect.

At this time, as shown in the drawing, there is provided an engaging member 115 at one side of the connection raw cloth member 114. The engaging member 115 might be formed in various types such as a Velcro ape, buttons, a zipper, a ring, etc.

Figure 5:
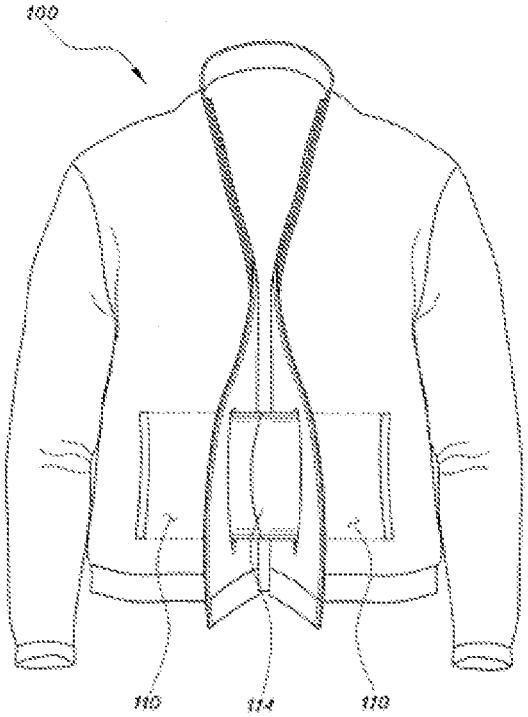
FIG. 5 is a view illustrating a state that a connection raw cloth member is engaged according to the present invention.

FIG. 5 shows a construction that a connection raw cloth member 114 is engaged. As shown therein, the connection raw cloth members 114 of both sides are provided, by means of which the pockets 110 of both sides are connected with each other, thus forming one integrated pocket 110.

At this time, the pockets 110 of both sides are connected with each other by means of the connection raw cloth member 114 with the above-mentioned construction in such a way that the opening and closing part 101 of the jacket 100 is opened, and the pockets 110 of both sides are connected by means of the engaging part 111, and then the connection raw cloth members 114 of both sides are engaged.

Figure 6:
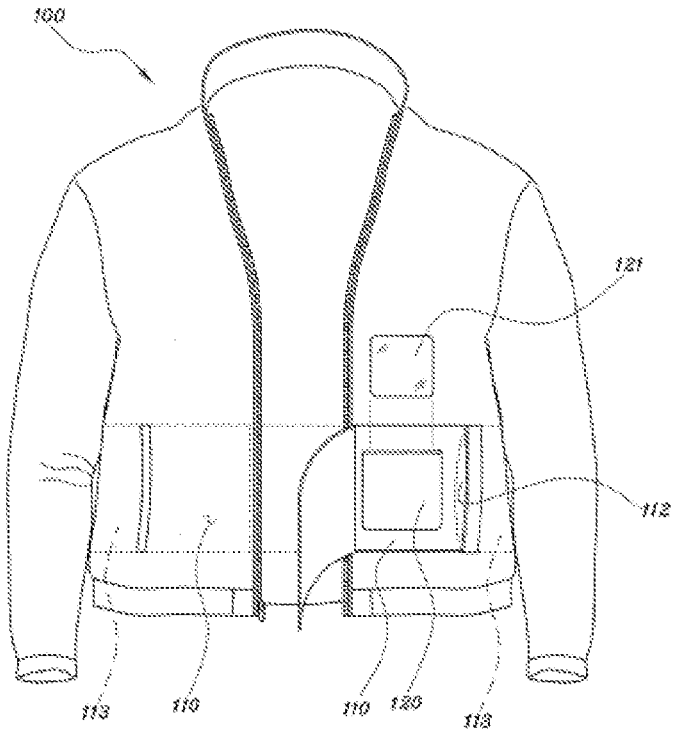
FIG. 6 is a view illustrating a construction that a heating element accommodation pocket is provided at an inner side while showing a pocket part by cutting away it according to the present invention.

FIG. 6 is a cut-away view for showing the inner side of the pocket 110. As shown therein, there is provided a heating element accommodation pocket 120 at an inner side of the pocket 110 for the purpose of accommodating the heating element 121. At one side of the inner surface of the pocket 110 is provided an opening part 112.

Figure 9:
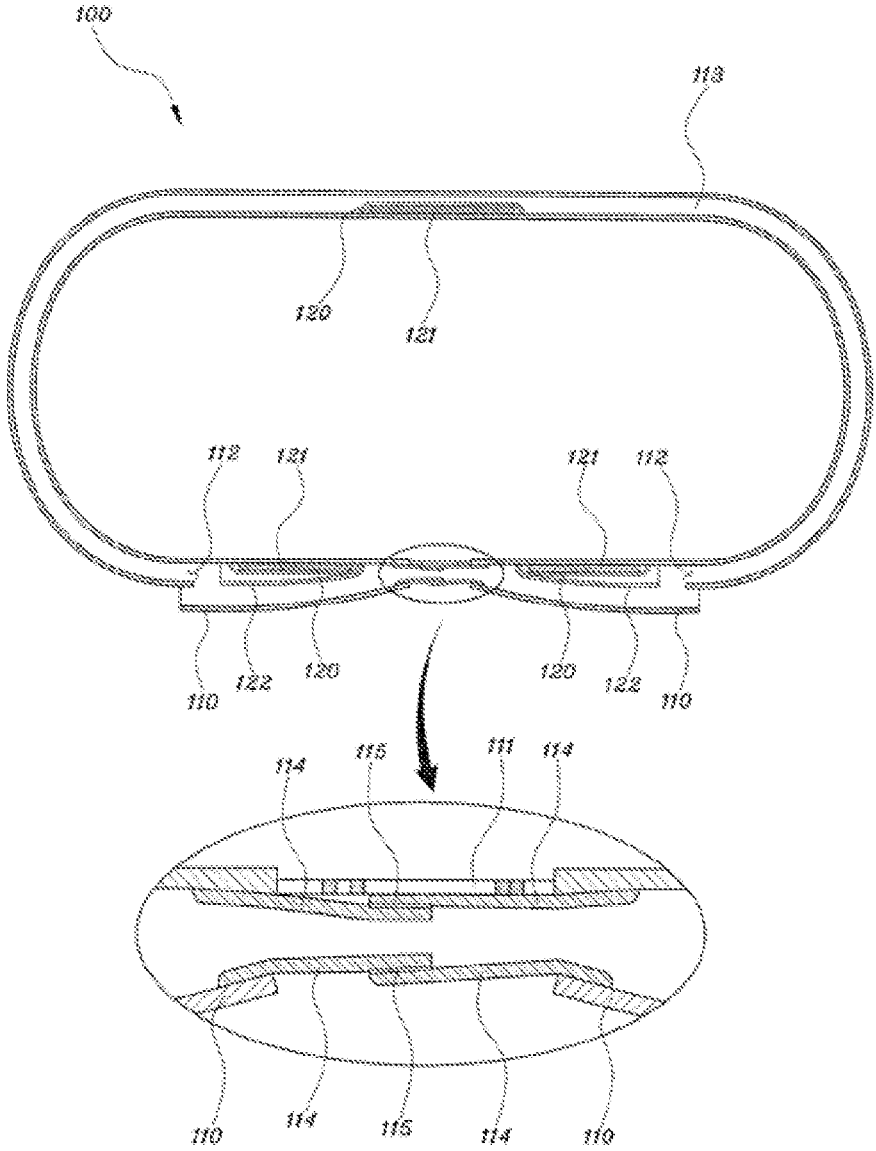
FIG. 9 is a cross sectional view taken along line A-A of FIG. 8.

As shown in FIG. 9, the opening part 112 of the pocket 110 will be described. The opening parts 112 are formed at the pockets 110 of both sides, and there is provided a through passage 113 connected with the backside of the pocket 110. Consequently, both the pockets 110 can communicate with each other by way of the through passage 113.

Even when the heating element 121 is accommodated in the pocket 110 with the aid of the through passage 113 constituted in the above described manner, heat can circulate, so heating effects can be obtained throughout the body.

Figure 7:
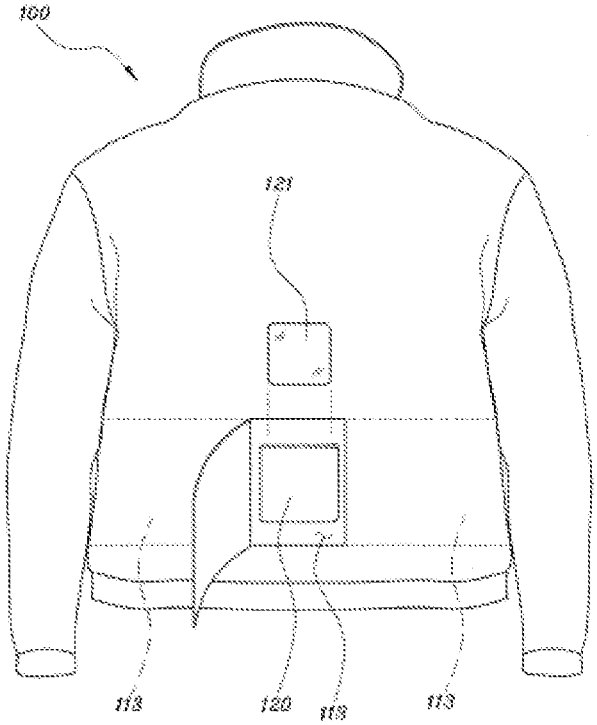
FIG. 7 is a view illustrating a construction that a heating element accommodation pocket is provided at an inner side while showing part of a backside of a jacket by cutting away it according to the present invention.

FIG. 7 is a view illustrating a partially cut-away portion in order to show the inner side of the backside of the jacket 100, namely, the through passage 113. As shown therein, there is provided a heating element accommodation pocket 120 at the through passage 113 for the purpose of accommodating the heating element 121.

Figure 8:
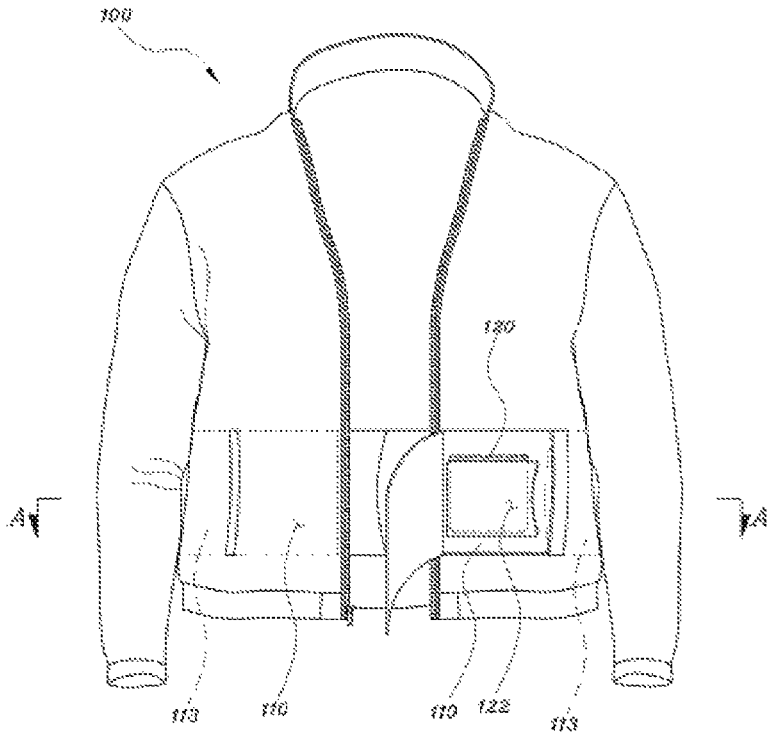
FIG. 8 is a view illustrating a construction that a warming cover pocket is formed at an inner side while showing a pocket part by cutting away according to the present invention.

FIG. 8 shows a construction that a warming cover pocket 122 is provided at an upper surface of the heating element accommodation pocket 120 provided at the pocket 110. The heat coming from the heating element accommodation pocket 120 can be effectively kept with the aid of the warming cover pocket 122. When a user puts hands into the pockets 110, it is preferred to input hands into between the heating element accommodation pocket 120 and the warming cover pocket 122, thus maximizing the warming effects.

It is preferred that the warming cover pocket 122 is made of a material which can effectively interrupt the emission of heat.

FIG. 9 is a cross sectional view taken along line A-A of FIG. 8. As shown therein, an opening part 112 is formed at one side of each inner surface of the pockets 110 of both sides. There is provided a through passage 113 connected to the backside of the jacket 100, and a heating element accommodation pocket 120 is provided at an inner side of each pocket 110 for the purpose of accommodating the heating element 121. A warming cover pocket 122 is formed at the upper surface of the warming cover pocket 122, and an engaging part 111 is formed for the purpose of connecting the pockets 110 of both sides. In addition, the connection raw cloth part 114 with an engaging member 115 at one side for the purpose of engaging the pockets 110 of both sides is formed at an end portion of one side of the pocket 110. The heating element accommodation pocket 120 is formed at one side of the through passage 113.

As described above, the pockets 110 of both sides are connected, and they are connected to the backside of the jacket 100 via the opening parts 112 of the pockets 110 by way of the through passage 113, so the pockets 110 of both sides communicate with each other.

Figure 10:
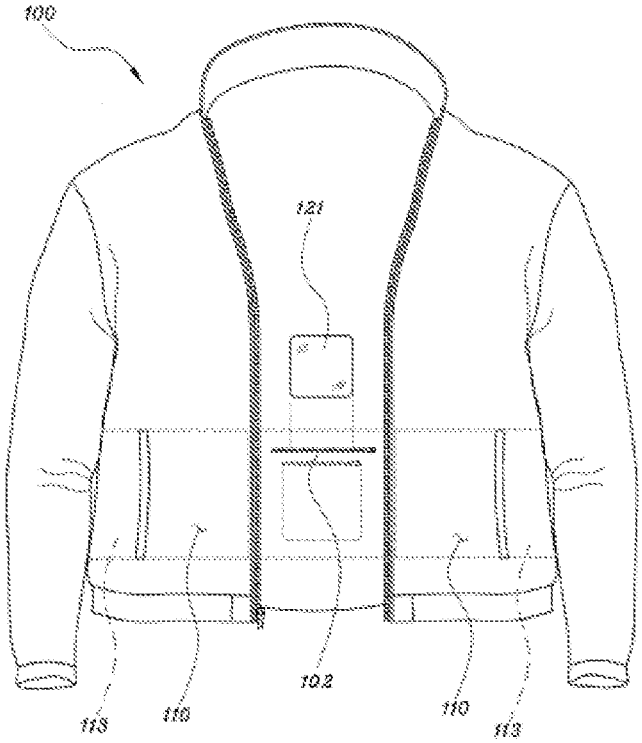
FIG. 10 is a view illustrating a construction that an input part for inputting a heating element is provided at an inner side of a jacket according to the present invention.
Figure 11:
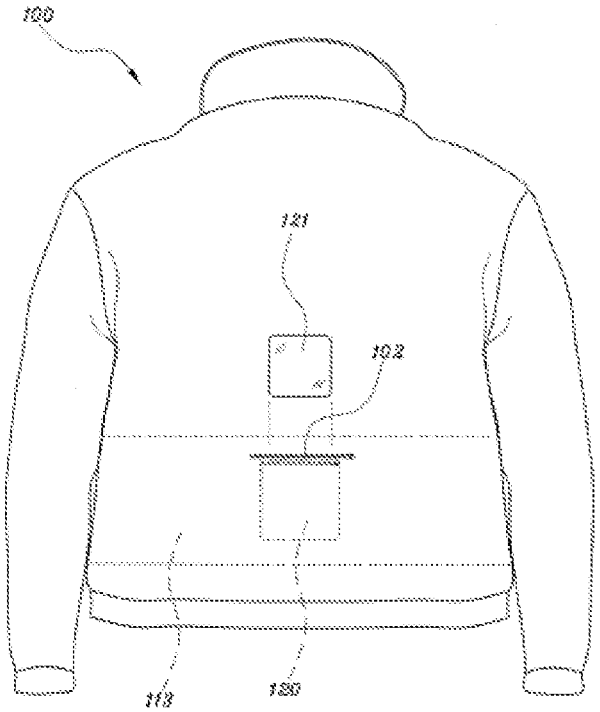
FIG. 11 is a view illustrating a construction that an input part for inputting a heating element is provided at an outer side of a jacket according to the present invention.

FIGS. 10 and 11 show a construction that the input part 102 at one side of an inner surface or an outer surface of the jacket 100. Here, the input part 102 helps easily accommodate the heating element 121 into the heating element accommodation pocket 120.

Figure 12:
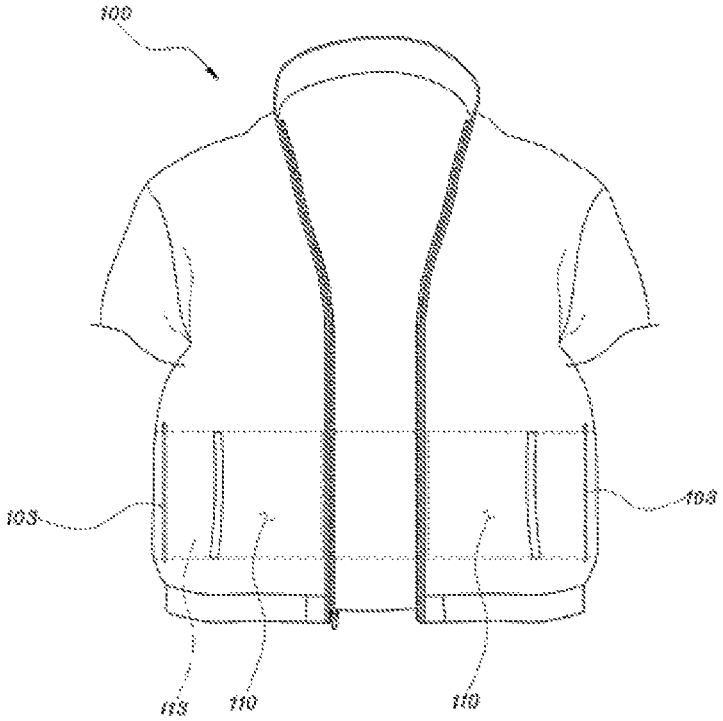
FIG. 12 is a view illustrating a construction that an operation opening and closing part is disposed at one side of a jacket according to the present invention.

FIG. 12 shows a construction that an operation opening and closing part 103 is provided at one side surface of the jacket 100. The operation opening and closing part 103 is provided to help easily operate a close contact part 130 which will be described later.

The close contact part 130 comes into close contact with the top 100, so it is possible to maximize an aesthetic appearance when wearing the jacket 100 as well as it is possible to enhance the warming effects now that the heating element accommodation pocket 120 comes into close contact with the body.

Here, various embodiments of the close contact part 130 will be described with reference to the accompanying drawings.

First of all, as not shown in the drawings, all or part of the jacket 100 is made of a flexible material, so that the heating element accommodation pocket 120 can come into close contact with the body.

Figure 13:
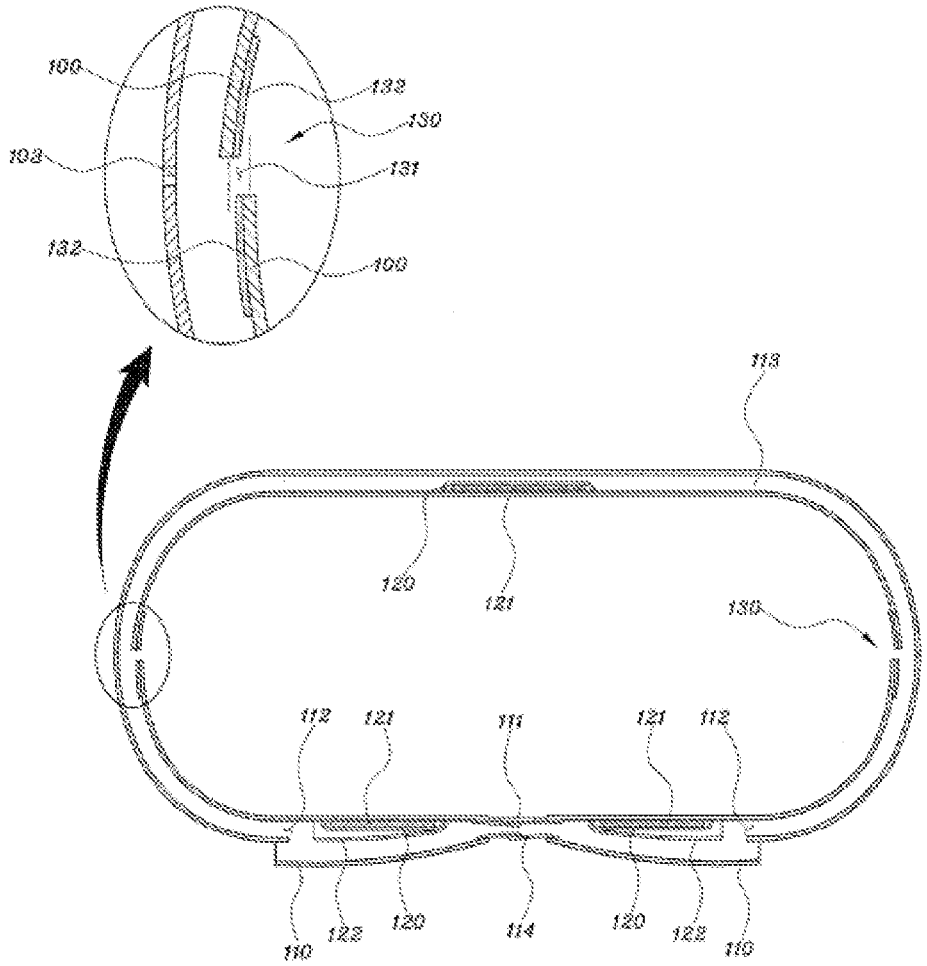
FIG. 13 is a plane cross sectional view illustrating a construction that a cutting-away part is formed at one side of a jacket according to the present invention.

FIG. 13 shows a construction that a cut-away part 131 is formed at one side of the jacket 100 in the embodiment of the close contact part 130. As shown in the accompanying drawings, a cut-away part 131 is formed at one side of the jacket 100, thus dividing into both sides, and an adhering member 132 is provided at one side of the cut-away part 131, so a user can engage the cut-away parts 131, which are divided into both sides to well fit his body, by using the adhering member 132.

Here, the cut-away part 131 is formed at an inner side of the jacket 100 as shown in the drawings, but it might be formed at an outer side of the jacket 100.

Figure 14:
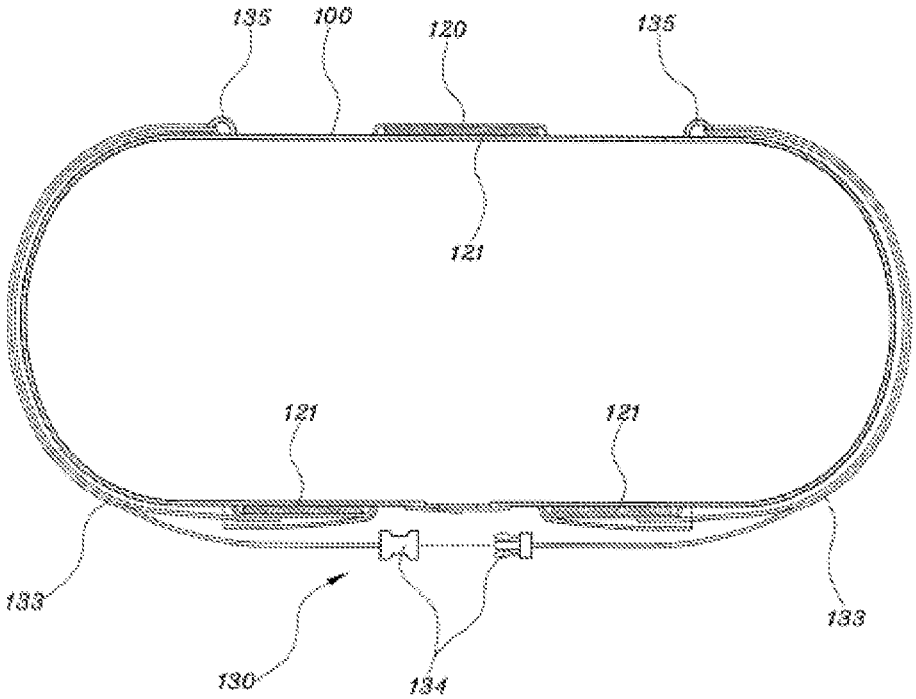
FIG. 14 is a plane cross sectional view illustrating a construction that a length adjusting band, which is an example of a close contact part, is provided according to the present invention.
Figure 15:
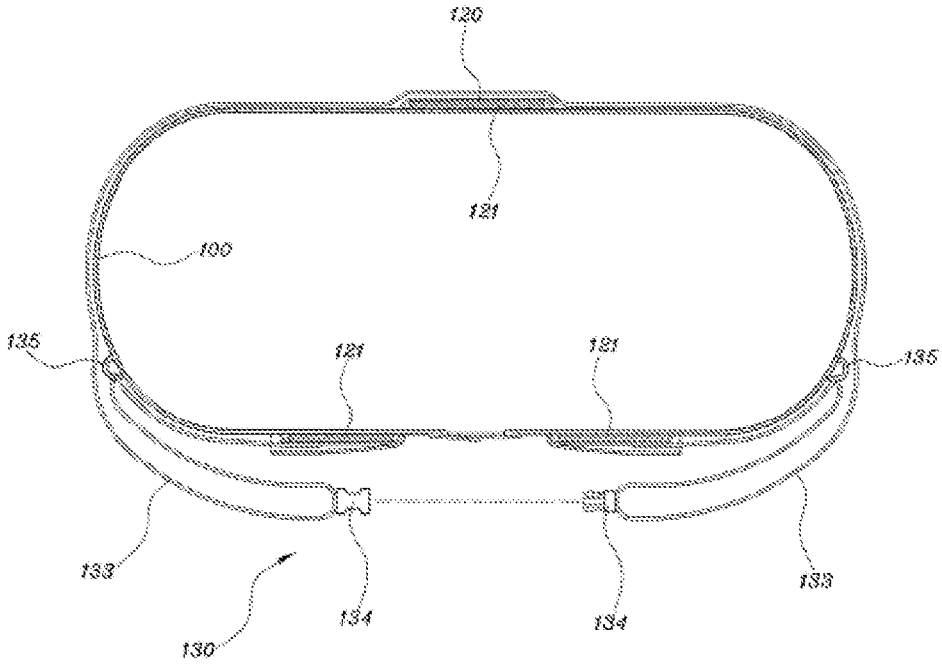
FIG. 15 is a plane cross sectional view illustrating another example of a length adjusting band which is an example of a close contact part according to the present invention.

FIGS. 14 and 15 show a construction that a length adjusting band 133 is used in the embodiment of the close contact part 130. As shown in the accompanying drawings, an engaging part 134 is provided at one side of the length adjusting band 133, and a ring 135 through which the length adjusting band 133 passes is formed at one side of the jacket 100.

As shown in FIG. 14, the other side of the length adjusting band 133 at one side of which the engaging part 134 is provided, is engaged to one side of the jacket 100, and the ring 135 through which the length adjusting band 133 passes is provided at one side of the jacket 100, and the length adjusting band 133 passes through the ring 135 and comes out of the ring 135, and each length adjusting band 133 is connected using the engaging part 134. Afterward, the heating element accommodation pocket 120 is made to come into close contact with the body by tightening the jacket 100.

In addition, as shown in FIG. 15, an engaging part 134 is provided at one end portion of the length adjusting band 133 both ends of which are engaged to one side of the jacket 100, respectively. The ring 135 through which the length adjusting band 133 passes is provided at one side of the jacket 100, respectively, and the length adjusting band 133 surrounds the backside of the jacket 100, and the length adjusting band 133 is pulled forward using each engaging part 134, thus engaging.

With the aid of the close contact part 130, it is possible to easily obtain an effective tightening operation in which the front side and the backside, which are mainly used, are tightly expanded, and the wrinkles can be gathered in a lateral direction, and it is possible to obtain another effect that it can be more strongly pushed or supported from the backside.

In addition, the length adjusting band 133 of the close contact part 130 can be formed so that it can be detachable from the jacket 100, so it is possible to use depending on a user's convenience.

The invention claimed is:

1. A jacket comprising:

a body;

first and second pockets respectively formed at both sides of a front of the body;

a first ring attached at a first position of the body;

a second ring attached at a second position of the body;

a first length adjustment band having a first end coupled to the body and extending toward an opening of the first pocket and the first ring and passing through an opening of the first ring and turning back the first ring to extend toward the first pocket to terminate at a second end thereof;

a first engaging unit coupled to the second end;

a second length adjustment band having a third end coupled to the body and extending toward an opening of the second pocket and the second ring and passing through an opening of the second ring and turning back the second ring to extend toward the second pocket to terminate at a fourth end thereof; and a second engaging unit coupled to the fourth end, wherein the first and second positions are spaced around the body, wherein the first and second engaging units are engaged with each other at the front of the body.

2. The jacket of claim 1, wherein the first end is located in the first pocket and the third end is located in the second pocket.

3. The jacket of claim 1, wherein the first and second positions are located at a rear of the body.

4. The jacket of claim 1, further comprising two openings formed at the body respectively at a position between the first pocket and the first ring and a position between the second pocket and the second ring.

5. The jacket of claim 1, further comprising a third length adjustment band extending from the second end to a rear of the body and a fourth length adjustment band extending from the fourth end to a rear of the body, wherein the third and fourth bands are integral with each other at the rear of the body.

6. The jacket of claim 5, wherein the first and second positions are respectively located nearby the openings of the first and second pockets.

7. The jacket of claim 1, wherein the body is, at an entirety thereof, open at an central line of the front thereof via a central vertical cutting.

8. The jacket of claim 7, further comprising a first partial opening formed at an inner side of the front of the body to be near to the cutting and face away the opening of the first pocket, and a second partial opening formed at an inner side of the front of the body to be near to the cutting and face away the opening of the second pocket.

9. The jacket of claim 8, further comprising a third engaging unit attached to the body at the first partial opening and a fourth engaging unit attached to the body at the second partial opening, wherein the third and fourth engaging unit are engaged with each other at the front of the body.

10. The jacket of claim 9, wherein the third engaging unit is attached to the body via a first connection cloth member coupled to the body at the first partial opening, and wherein the fourth engaging unit is attached to the body via a second connection cloth member coupled to the body at the second partial opening.

11. The jacket of claim 1, further comprising a tube-channel formed from the opening of the first pocket through the rear of the body to the opening of the second pocket.

12. The jacket of claim 11, further comprising a heating member accommodation space formed in the first pocket, second pocket or tube channel.

13. The jacket of claim 1, wherein the first and second positions are respectively located nearby the openings of the first and second pockets.

* * * * *